313-422 SR
7/4/78 OR 4,099,087

United States Patent [19]
Peters

[11] 4,099,087
[45] Jul. 4, 1978

[54] GUIDED BEAM FLAT DISPLAY DEVICE WITH FOCUSING GUIDE ASSEMBLY MOUNTING MEANS

[75] Inventor: Kenneth Donald Peters, Cranbury, N.J.

[73] Assignee: RCA Corporation, New York, N.Y.

[21] Appl. No.: 783,218

[22] Filed: Mar. 31, 1977

[51] Int. Cl.[2] ..... H01J 29/72; H01J 29/08; H01J 31/00

[52] U.S. Cl. ..... 313/422; 313/432

[58] Field of Search ..... 313/422, 417, 105 R, 313/409, 444, 432

[56] References Cited

U.S. PATENT DOCUMENTS

| | | | |
|---|---|---|---|
| 4,028,582 | 6/1977 | Anderson et al. | 313/422 |
| 4,031,427 | 6/1977 | Stanley | 313/422 |

*Primary Examiner*—Robert Segal
*Attorney, Agent, or Firm*—Eugene M. Whitacre; Donald S. Cohen; Glenn H. Bruestle

[57] ABSTRACT

An evacuated envelope including a plurality of spaced, parallel support walls extending and substantially perpendicular to flat, substantially parallel front and back walls to provide a plurality of parallel channels extending along the front and back walls. Between each of the support walls and the back wall are a plurality of longitudinally spaced spacer members, each of which has a ledge projecting into an adjacent channel but spaced from the back wall. Within each of the channels is an assembly which includes a pair of spaced, parallel focusing guide grid plates. One of the grid plates has spring tabs at spaced points along its edges which tabs fit under the ledges of the spacer members to hold the assembly in fixed position with respect to the back wall. The other grid plate has spaced location tabs along its edges which engage the spacer members to align the assembly in the channel with respect to the support walls.

11 Claims, 5 Drawing Figures

GUIDED BEAM FLAT DISPLAY DEVICE WITH FOCUSING GUIDE ASSEMBLY MOUNTING MEANS

BACKGROUND OF THE INVENTION

The present invention relates to a guided beam flat display device having a unitary beam guide assembly, and particularly to such a device of a construction which permits the beam guide assembly to be quickly and accurately mounted in the device.

There has been developed a flat display device which includes an evacuated envelope including substantially flat, spaced front and back walls and spaced, parallel support walls extending between the front and back walls. The support walls form a plurality of parallel channels extending across the front and back walls. A gun structure extends across one end of the channels and is adapted to generate electrons and direct the electrons as beams into the channels. In each of the channels is at least one beam guide which confines the electrons in the beam as they flow along the channels but which permits the beam to be deflected toward a phosphor screen on the surface of the front wall at a plurality of points along the channel. Such a display device is described in the copending application for U.S. Patent of T. O. Stanley, Ser. No. 607,492, filed Aug. 25, 1975, now U.S. Pat. No. 4,031,427; June 21, 1977, entitled "Flat Electron Beam Addressed Device". This type of display device will be generally referred to as a "guided beam display device".

One type of beam guide which has been developed for use in a guided beam display device includes a pair of spaced, parallel plates extending transversely across and longitudinally along the channels in closely spaced relation to the back wall. The plates have a plurality of openings therethrough which are arranged in rows both longitudinally along and transversely across the plates. The openings in one of the plates are in alignment with the openings in the other plate. Each longitudinal row of openings is a separate beam guide. On the inner surface of the back wall are a plurality of spaced, parallel conductors which extend transversely across the channels. Each of the conductors extends along a separate transverse row of the openings in the plates. This beam guide and its operation is described in the copending application for U.S. Pat. Of W. W. Siekanowicz et al, Ser. No. 671,358, filed Mar. 29, 1976, entitled "Flat Display Device With Beam Guide".

In the copending application for U.S. Letters Patent of C. H. Anderson et al, Ser. No. 615,353, filed Sept. 22, 1975, now U.S. Pat. No. 4,028,582, June 7, 1977, entitled "Guided Beam Flat Display Device" there is shown and described a type of the guided beam flat display device in which there are three beams in each channel and at each point that the beams are deflected out of their focusing guides towards the phosphor screen the beams are simultaneously deflected transversely across the channels to scan the screen across the entire lateral dimension of the channel. This display device includes two spaced parallel grids between the focusing guides and the phosphor screen. One of the grids is for focusing the cross sectional area of the beams and the other grid is for accelerating the beams toward the phosphor screen. This type of the guided beam display device will be referred to as a "modular guided beam display device".

For the commercial production of a modular guided beam display device it is desirable to be able to quickly and easily assemble the various elements of the device with high precision, particularly the focusing guide and the focusing and accelerating grids. In the copending application for U.S. Patent of Z. M. Andrevski, Ser. No. 775,300, filed March 7, 1977, entitled "Flat Display Device With Beam Guide", there is shown and described a unitary assembly of the focusing guide and focusing and accelerating grids which can be slid into one end of each of the channels. Although this assembly greatly simplifies the assembling of the display device, it still has problems with regard to inserting the assembly with precision of alignment in the channel.

SUMMARY OF THE INVENTION

In a guided beam display device a spacer means is disposed between each of the support walls and the back wall. Said spacer means has spaced ledges extending into an adjacent channel which ledges are spaced from the back wall. In each of the channels is an assembly which includes a pair of substantially rectangular plates secured together in spaced parallel relation. Each of the assemblies extends along but is spaced from the back wall. Each of the assemblies includes spaced spring tabs disposed between the ledges and the back wall and holding the assembly in place with respect to the back wall.

DETAILED DESCRIPTION OF THE INVENTION

Figure 1:
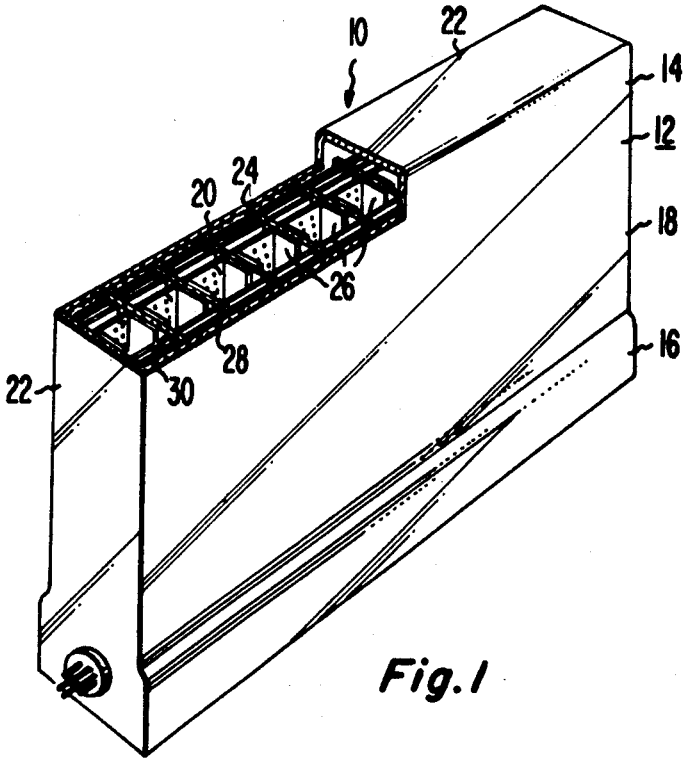
FIG. 1 is a perspective view, partially broken away, of a form of the display device of the present invention.

Referring to FIG. 1, one form of a flat display device of the present invention is generally designated as 10. The display device 10 comprises an evacuated envelope 12, typically of glass, having a display section 14 and an electron gun section 16. The display section 14 includes a rectangular, substantially flat front wall 18 which supports the viewing screen, and a rectangular, substantially flat back wall 20 in spaced parallel relation to the front wall 18. The front wall 18 and back wall 20 are connected by side walls 22. The front wall 18 and back wall 20 are dimensioned to provide the size of the viewing screen desired, e.g. 75 × 100 cm, and are spaced apart about 2.5 to 7.5 cm.

A plurality of spaced, parallel support walls 24 are secured between and substantially perpendicular to the front wall 18 and the back wall 20 and extend from the gun section 16 to the opposite side wall 22. The support walls 24 provide the desired internal support for the evacuated envelope 12 against external atmospheric pressure and divide the display section 14 into a plurality of parallel channels 26. Between each of the support walls 24 and the inner surface of the back wall 20 are a plurality of support wall spacer members 28.

Figure 2:
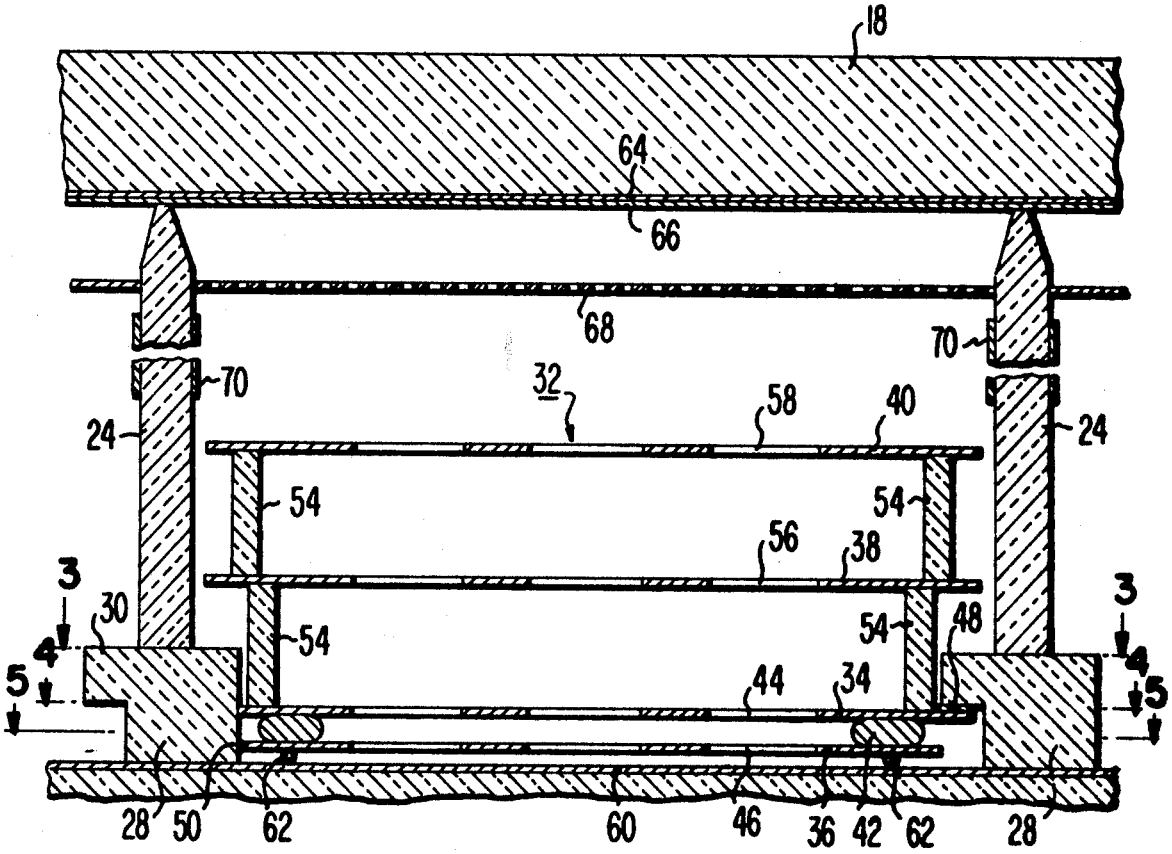
FIG. 2 is a sectional view transversely across one of the channels of the display device.

As shown in FIG. 2, each of the support wall spacer members 28 is substantially rectangular in transverse cross section and has a ledge 30 projecting from one side into an adjacent channel 26. The ledges 30 are spaced from the inner surface of the back wall 20.

Figure 3:
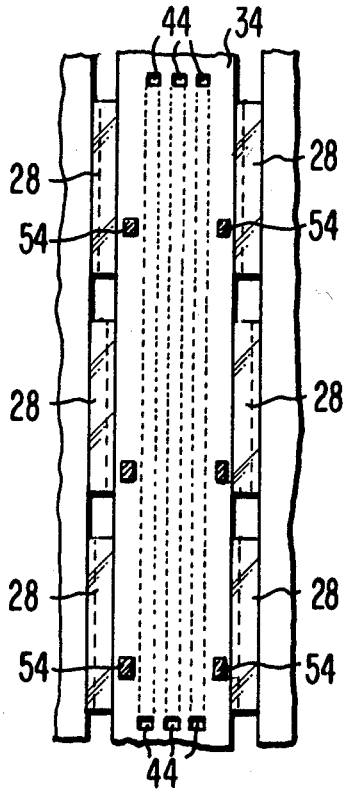
FIG. 3 is a sectional view taken along line 3—3 of FIG. 2 along a portion of the channel.

As shown in FIG. 3, the support wall spacer members 28 are in spaced relation along the length of the channels 26 and are arranged in rows transversely across the channels 26. The support wall spacer members in each transverse row have their ledges 30 extending in the same direction therefrom but in the opposite direction from those of an adjacent transverse row. Thus, along each of the channels 26 a ledge 30 projects into the channel from only one of the each opposed pair of the support wall spacer members 28 with the ledges extending from opposite sides of the channel at alternate pairs of the support wall spacer members.

The support wall spacer members 28 along with the support walls 24 are preferably made of glass. The support wall spacer members 28 are secured to the support walls 24 and to the back wall 20 by a suitable bonding material, such as a sintered glass frit.

In each of the channels 26 is an assembly 32 which includes a pair of focusing guide grid plates 34 and 36, a focusing grid 38 and an acceleration grid 40 secured together is spaced apart, parallel relation. The focusing guide grid plates 34 and 36 are each rectangular and have a length substantially equal to the length of the channels 26 and a width no greater than the spacing between the rows of the support wall spacer members 28. The focusing guide grid plates 34 and 36 are secured together in spaced, parallel relation by elongated, metal spacer members 42 which are between the focusing guide grid plates along their elongated edges and to which the focusing guide grid plates are secured. The focusing guide grid plates 34 and 36 have a plurality of rectangular openings 44 and 46 respectively therethrough. The openings 44 and 46 are arranged in rows both longitudinally along and transversely across the grid plates with each of the openings 44 in the grid plate 34 being aligned with a separate opening 46 in the grid plate 36.

Figure 4:
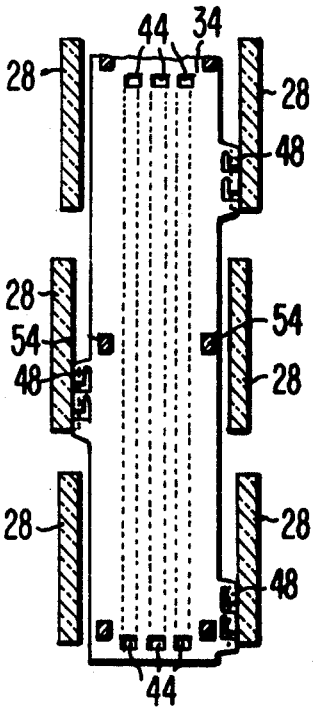
FIG. 4 is a sectional view taken along line 4—4 of FIG. 2 along a portion of the channel.

As shown in FIG. 4, each of the focusing guide grid plates 34 has sets of spring tabs 48 spaced along its elongated edges. The sets of spring tabs 48 are in staggered relation along the edges of the focusing guide grid plate 34 so that when the assembly 32 is mounted in the channel 26 each set of the spring tabs will be juxtaposed with a spacer member ledge 30 projecting into that channel. The ends of the spring tabs 48 are bent out of the plane of the grid 34 to project away from the focusing guide grid plate 36.

Figure 5:
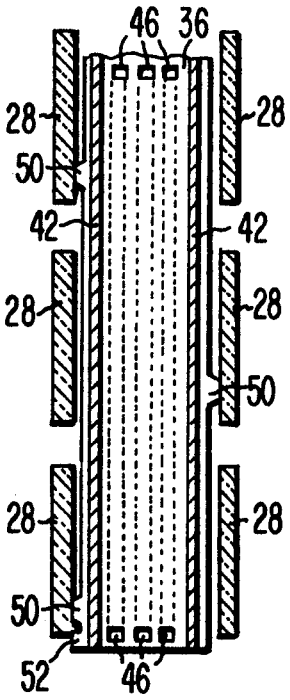
FIG. 5 is a sectional view taken along line 5—5 of FIG. 2 along a portion of the channel.

As shown in FIG. 5, each of the focusing guide grid plates 36 has a plurality of location tabs 50 projecting from and spaced along its elongated edges. The location tabs 50 are in staggered relation along the focusing guide grid plate 36 and are positioned so that when the assembly 32 is within its respective channel 26 each of the location tabs 50 is juxtaposed with a spacer member 28 at a point therealong which is void of a ledge projecting into the respective channel. Thus, each of the location tabs 50 is in alignment with a set of the spring tabs 48 laterally of the channel 26 but the location tab 50 is on the side of the assembly 32 opposite the side from which the aligned spring tabs 48 project. The focusing guide grid plate 36 also has a longitudinal location tab 52 projecting from one side edge at one end thereof. The longitudinal location tab 52 is of a length so as to project beyond and adjacent location tab 50.

The focusing grid 38 and acceleration grid 40 are each rectangular metal plates of a length corresponding to the longitudinal length of the channel and a width no greater than the lateral distance between the support walls 24. The focusing grid 38 is secured in spaced, parallel relation to the focusing guide grid plate 34 by spacer posts 54 of an electrical insulating material, such as ceramic or glass. The spacer posts 54 are mounted in spaced relation along the elongated edges of the focusing grid 38 and focusing guide grid plate 34. Similarly, the acceleration grid 40 is secured in spaced parallel relation to the focusing grid 38 by spacer posts 54 which are mounted is spaced relation along the elongated edges of the acceleration grid 40 and focusing grid 38. The focusing grid 38 and acceleration grid 40 have a plurality of rectangular openings 56 and 58 respectively therethrough. The openings 56 and 58 are arranged in rows longitudinally along and transversely across the grids with each of the openings 56 and 58 being aligned with a pair of openings 44 and 46 in the focusing guide grid plates 34 and 36.

On the inner surface of the back wall 20 are a plurality of spaced, parallel conductors 60, only one of which is shown. The conductors 60 are strips of an electrically conductive material, such as a metal, coated on the inner surface of the back wall. The conductors 60 extend transversely across the channels 26 and have a center to center spacing along the channels equal to the center to center spacing of the transverse rows of the openings 44 and 46 in the focusing guide grid plates. Each conductor 60 is disposed opposite a set of openings 44 and 46. In each of the channels 26 are a pair of spacer rods of an electrical insulating material, such as glass, which are mounted on the inner surface of the back wall 20 in parallel relation along the channel 26. The spacer rods 62 are circular in transverse across section and are of a diameter equal to the desired spacing between the focusing guide grid plate 36 and the conductors 60.

Each of the assemblies 32 is mounted in its respective channel 26 with the focusing guide grid plate 36 being seated on the spacer rods 62. Each set of spring tabs 48 is between the ledge 30 of its adjacent support wall spacer member 28 and the back wall 20 of the envelope 12. The ends of the spring tabs 48 are pressed against the ledge 30 so as to spring bias the focusing guide grid plate 36 firmly against the spacer rods 62. The location tabs 50 on the focusing guide grid plate 36 engage the side walls of their adjacent support wall spacer members 28. this aligns the assembly 32 longitudinally in the channel 26 so that the longitudinal rows of the openings in the focusing guide grid plates of all of the assemblies 32 are all parallel with respect to each other. The longitudinal location tab 52 on the focusing guide grid plate 36 engages an end of one of the support wall spacer members 28 so as to properly locate the assembly 32 longitudinally in the channel 26. This aligns the transverse rows of the openings 44 and 46 in the focusing guide grid plates 34 and 36 of the assemblies 32 in all of the channels 26.

To mount the assembly 32 in the channel 26, the assembly is inserted into the channel with the location tabs 50 and spring tabs 48 passing through the spaces between the support wall spacer members 28 until the focusing guide grid plate 36 is seated on the spacer rods 62. The assembly 32 is then moved longitudinally in the channel to slide the spring tabs 48 between the ledges 30 of the support wall spacer members 28 and the back wall 20 and to bring the location tabs 50 into contact with the support wall spacer members 28. The assembly 32 is moved longitudinally until the longitudinal location tab 52 engages the end of a support wall spacer member 28. Thus, the assembly 32 can be easily mounted in its respective channel 26 with only a short longitudinal movement of the assembly. When so mounted, the spring tabs 48 firmly hold the assembly in place and the location tabs 50 and 52 properly align the assembly with respect to all of the assemblies 32 in the other channels 26.

On the inner surface of the front wall 18 is a phosphor screen 64. The phosphor screen 64 may be of any well known type presently being used in cathode ray tubes, e.g. black and white or color television display tubes. A metal film electrode 66 is provided on the phosphor screen 64. A shadow mask 68 extends across each of the channels 26 adjacent to but spaced from the phosphor screen 64. The shadow mask 68 has openings therethrough through which the electrons pass in their paths toward the phosphor screen 64. On the surface of the support walls 24 are deflection electrodes 70 which extend between the shadow mask 68 and the acceleration grid 40 of the assembly 32 along the entire length of the channel 26.

The gun section 16 is an extension of the display section 14 and extends along one set of adjacent ends of the channels 26. The gun section may be of any shape suitable to enclose the particular gun structure contained therein. The electron gun structure contained in gun section 16 may be of any well known construction suitable for selectively directing beams of electrons along each of the channels. For example, the gun structure may comprise a plurality of individual guns mounted at the ends of the channels 26 for directing separate beams of electrons along the channels. Alternatively, the gun structure may include a line cathode extending along the gun section 16 across the ends of the channels 26 and adapted to selectively direct individual beams of electrons along the channels. A gun structure of the line type is described in U.S. Pat. No. 2,858,464 to W. L. Roberts issued Oct. 28, 1958 entitled "Cathode Ray Tube".

In the operation of the display device 10, a high positive potential, typically about +300 volts, is applied to each of the conductors 60, and a low positive potential, typically about +40 volts is applied to each of the focusing guide grid plates 34 and 36 of the assembly 32. A high positive potential, typically between +2000 volts and +8000 volts, is applied to the acceleration grid 40 and the metal film electrode 66 on the phosphor screen 64. The focusing grid 38 has applied thereto a potential which is positive with respect to the focusing guide grid plates 34 and 36 but not as positive as the potential applied to the acceleration grid 40.

Beams of electrons are directed into the channels 26 between the focusing guide grid plates 34 and 36 of the assembly 32 with each beam being directed along a longitudinal row of the grid plate openings 44 and 46. As described in the application of W. W. Siekanowicz et al, Ser. No. 671,358, the potential difference between the focusing grid plate 36 and the conductors 60 and the potential difference between the focusing grid plate 34 and the acceleration grid 40 creates an electrostatic force field within the space between the focusing guide grid plates 34 and 36. This force field applied forces to the electrons to confine the electrons to the beam in directions perpendicular to the planes of the focusing guide grid plates and transversely of the channel. The beams can be selectively deflected out of the assembly 32 toward the phosphor screen 64 at each of the transverse rows of the focusing guide grid plate openings to achieve a line-by-line scan of the phosphor screen by selectively switching the potential applied to each of the conductors 60 to a negative potential such as −100 volts.

As the electron beams flow from the assembly 32 to the phosphor screen 64, the electron beams pass between the deflection electrodes 70. As described in the application of C. H. Anderson et al, Ser. No. 615,353 now U.S. Pat. No. 4,028,582, a potential difference is applied to the deflection electrode 70 in each of the channels 26 which causes the beams to be deflected transversely across the channels 26. Thus, the beams in each of the channels are scanned across the portion of the phosphor screen which extends across the respective channel so that the combined scans of the beams in all of the channels provide a complete horizontal line scan of the phosphor screen. The transverse scanning of the phosphor screen 28 is combined with the scanning longitudinally along the channels to light up the entire screen. By modulating the beams at the gun structure, a display can be achieved on the phosphor screen 64 which can be viewed through the front wall 18 of the display device.

I claim:

1. A display device comprising an evacuated envelope including spaced, substantially parallel front and back walls, spaced, parallel support walls between and substantially perpendicular to said front and back walls forming a plurality of parallel channels extending across the front and back walls, and spacer means between each of said support walls and the back wall, said spacer means including spaced ledges extending into an adjacent channel but spaced from the back wall, an assembly in each of said channels which assembly includes a pair of substantially rectangular plates secured together in spaced parallel relation, the assembly extending along but spaced from the back wall, and the assembly including spaced spring tabs disposed between the spacer means ledges and the back wall and holding the assembly in place with respect to the back wall and spacer means ledges.

2. A display device in accordance with claim 1 wherein the spacer means comprises a plurality of spacer members in spaced relation between each of the support walls and the back wall with each of the spacer members having a ledge extending into an adjacent channel.

3. A display device in accordance with claim 2 in which the spacing tabs are on one of the plates of the assembly and engage the ledge of the spacer members to hold the assembly in place.

4. A display device in accordance with claim 3 in which one of the plates has a plurality of location tabs projecting from its elongated edges, said location tabs engaging the spacer members to align the assembly longitudinally along the channel between the spacer members.

5. A display device in accordance with claim 4 including a pair of spaced spacer rods extending along and secured to the inner surface of the back wall in each channel, and the spring tabs hold one of the plates against said spacer rod.

6. A display device in accordance with claim 5 in which the location tabs are on the plate which is held against the spacer rods and the spring tabs are on the other plate.

7. A display device in accordance with claim 6 in which the spacer members are arranged in rows transversely of the channels, all of the spacer members in each transverse row having their ledges projecting in the same direction with spacer members in alternate rows having their ledges projecting in opposite directions so that along each channel the ledges project into the channel alternatively from opposite sides of the channel.

8. A display device in accordance with claim 7 in which the location tabs are positioned to engage the sides of the spacer members which do not have a ledge projecting into the respective channel.

9. A display device in accordance with claim 8 in which the plates having the location tabs also have a longitudinal location tab projecting from a side thereof beyond the other location tabs, said longitudinal tab engaging an end of a spacer member to position the assembly longitudinally within the channel.

10. A display device in accordance with claim 9 in which each of the spring tabs is in transverse alignment with a location tab but projects from the assembly in the opposite direction from the location tab.

11. A display device in accordance with claim 10 including a focusing grid secured in spaced, parallel relation to the other plate and an acceleration grid secured in spaced, parallel relation to said focusing grid.

* * * * *